US005366030A

United States Patent [19]

Pool, II et al.

[11] Patent Number: 5,366,030

[45] Date of Patent: Nov. 22, 1994

[54] HYDRAULIC DEVICE FOR FORMING A CAVITY IN A BOREHOLE

[76] Inventors: F. W. Pool, II, 370 Clayton St., Denver, Colo. 80206; MacDonald Hawley, 2659 Bridger Ct., Evergreen, Colo. 80439; Gregory J. Abramov, ulitsa Udaltsova, 14, kv .96, Moscow, Russian Federation

[21] Appl. No.: 969,966

[22] Filed: Nov. 2, 1992

[51] Int. Cl.[5] ..... E21B 7/18; E21B 17/18

[52] U.S. Cl. ..... 175/215; 175/324; 175/424; 299/17

[58] Field of Search ..... 299/17; 175/215, 67, 175/324, 424

[56] References Cited

U.S. PATENT DOCUMENTS

| | | | |
|---|---|---|---|
| Re. 29,021 | 11/1976 | Archibald et al. | 175/213 |
| 1,851,565 | 3/1932 | Claytor . | |
| 1,915,136 | 6/1933 | Share . | |
| 2,518,591 | 8/1950 | Aston et al. . | |
| 2,720,381 | 10/1955 | Quick . | |
| 2,838,120 | 6/1958 | Allmendinger et al. . | |
| 3,155,177 | 11/1964 | Fly . | |
| 3,747,696 | 7/1973 | Wenneborg et al. | 175/87 |
| 3,951,457 | 4/1976 | Redford . | |
| 4,134,619 | 1/1979 | Bunnelle | 299/17 |
| 4,140,346 | 2/1979 | Barthel | 299/17 |
| 4,275,926 | 6/1981 | Hodges | 299/17 |
| 4,296,970 | 10/1981 | Hodges | 299/67 |
| 4,401,345 | 8/1983 | Archibald | 299/64 |
| 4,405,176 | 9/1983 | Hodges | 299/17 |
| 4,415,206 | 11/1983 | Hodges | 299/17 |
| 4,420,187 | 12/1983 | Hodges | 299/17 |
| 4,527,836 | 7/1985 | Uhri | 299/17 |
| 4,575,155 | 3/1986 | Hodges | 299/17 |
| 4,718,728 | 1/1988 | Hodges | 299/17 |
| 4,934,466 | 6/1990 | Paveliev et al. | 175/102 |
| 5,127,710 | 7/1992 | Babichev et al. | 299/17 |
| 5,181,578 | 1/1993 | Lawler | 175/424 |

FOREIGN PATENT DOCUMENTS

| | | | |
|---|---|---|---|
| 160121 | 5/1983 | Germany | 299/17 |
| 708055 | 1/1980 | U.S.S.R. | 299/17 |
| 1157239 | 5/1985 | U.S.S.R. | 299/17 |
| 1265344 | 10/1986 | U.S.S.R. | 299/17 |
| 1283389 | 1/1987 | U.S.S.R. | 299/17 |

*Primary Examiner*—Hoang C. Dang
*Attorney, Agent, or Firm*—Staas & Halsey

[57] ABSTRACT

An hydraulic device for forming a cavity in a borehole. The device includes generally the following modular sections: a hub section for connection to a drill pipe; hydromonitor (cutting nozzle); hydroelevator (eductor); and drill bit box. Through each section, except the drill bit box, extends first and second concentric pipelines for delivering fluid into the device and directing slurry out of the device. Only the drill pipe extends to the surface to receive standard well blowout prevention equipment. The second pipeline releases slurry into a casing which channels, in cooperation with an upper portion of the first pipeline and the drill pipe, the slurry to the surface. The hydromonitor includes a nozzle which is hydraulically associated with the first pipeline, and extends through the second pipeline, for delivering fluid into the borehole to form the cavity. The eductor pulls spent cutting fluid, coal fines, etc., out of the cavity as the slurry. A seal is located between the hub section and the casing to prevent methane gas from moving into the casing, except by way of the second pipeline carrying the slurry, and to prevent the slurry from returning to the cavity from the casing.

17 Claims, 6 Drawing Sheets

HYDRAULIC DEVICE FOR FORMING A CAVITY IN A BOREHOLE

BACKGROUND OF THE INVENTION

1. Field of the Invention

The invention relates to an hydraulic mining device for forming a cavity in a borehole and, more particularly, to a device for forming a cavity in a coal seam to expose naturally occurring fractures, thereby enhancing the ability of methane gas trapped in the coal seam to be released through the fractures and recovered as an energy source.

2. Description of the Prior Art

U.S. Pat. No. 4,934,466 (hereinafter the '466 patent) describes a device for borehole hydraulic mining. The device generally includes first inner and second outer concentric pipelines for delivering fluid into a borehole and bringing a slurry (water, coal, sand and rock pieces) to the surface, respectively. A nozzle is secured to and hydraulically associated with the first pipeline, and extends through the second pipeline, for delivering the fluid into the borehole. An hydroelevator is secured to the lower end of the second pipeline, below the nozzle, for bringing the slurry to the surface.

Since the device extends all the way to the surface, assembly of the device would be very time consuming in a typical well because of the number of concentric strings of pipe necessary. In addition the device would require a very large drilling rig to handle the weight and associated pipe. Moreover, the device being so heavy frustrates insertion, operation and removal procedures.

This device is also relatively unitary with the functional portions such as nozzle and hydroelevator having set orientations. It is not possible to lengthen the device on site, or reverse the positions of the functional portions, e.g., nozzle and hydroelevator, if desired.

Further, since the entrance to the hydroelevator is fully open, there is no way to prevent relatively large coal pieces cut by hydraulic pressure from entering the hydroelevator. Blockage has been known to occur at this unrestricted entrance.

Also, since the entrance to the hydroelevator is open, i.e., a structural interruption is formed in the outer pipe, the device is supported at the hydroelevator only by the inner pipe. As the tool is rotated, e.g., if it becomes bound, torque could damage the inner pipe. This may result in a broken device incapable of being totally removed from the borehole, or if removable, may require extensive repairs. In either case, costs are increased.

In addition to the above drawbacks, the device of the '466 patent is not applicable specifically to enhancing recovery of methane from underground coal seams for the following reasons.

A critical problem in any well where methane is present is the chance the methane will escape to the surface uncontained and cause what is known in the industry as a blowout. Since the device of the '466 patent includes two steel concentric pipes extending all the way to the surface, too much steel is present at the surface to ensure cutting off the well by standard well blowout prevention equipment.

The prior art device also is not intended to receive standard oil field equipment which allows removal of the device from a well after the well starts producing methane. The device is instead intended to mine only minerals per se.

Thus, the prior art still does not provide the most efficient, safe and cost-effective hydraulic device for forming cavities in a coal seam so that methane recovery can be significantly enhanced.

SUMMARY OF THE INVENTION

Accordingly, it is a purpose of the present invention to provide a lighter yet stronger device for forming a cavity in a borehole.

It is another purpose of the present invention to provide a device for forming a cavity in a borehole, which device is far less likely to become clogged or bound during operation.

It is another purpose of the present invention to provide a device for enhancing methane recovery from a coal seam by creating a non-collapsing cavity in the coal seam, which cavity exposes many pre-existing fractures for continuous methane escape.

It is another purpose of the present invention to provide a device for enhancing methane recovery, which device incorporates only a single inner tube extending to the surface, which pipe can be connected to standard well equipment.

It is another purpose of the present invention to provide a cavity forming device used in enhancing methane recovery, which device includes a seal at an interface of an outer tube and a casing to prevent methane gas from moving up the casing from the cavity, except through the outer tube of the device, and to prevent slurry from returning to the cavity from the casing.

It is another purpose of the present invention to provide a seal between an hydraulic cavity forming device and a casing, which seal causes methane gas from a coal seam to accumulate in the cavity and form a gas bubble within which an hydromonitor of the device operates to cut through the coal seam.

It is another purpose of the present invention to provide a device for forming a coal seam cavity for enhancing methane recovery, said device using an hydraulic nozzle, an eductor, a seal between the device and a casing, at the top of the cavity, and a single inner tube running to the surface.

Finally, it is another purpose of the present invention to provide a modular device for forming a cavity in a coal seam, wherein components thereof can be interchanged or replaced or the device can be lengthened, as the need arises, at the well site.

To achieve the foregoing and other purposes of the present invention there is provided a device including generally the following modular sections in order from top to bottom: hub section; tube section; hydromonitor (cutting nozzle); spacer sub; hydroelevator (eductor); and drill bit box. The upper end of the hub section connects to a drill string or pipe. Through each section, except the drill bit box, extends first and second concentric tubes or pipelines for delivering fluid into the device and bringing slurry through the device to the surface, respectively. The hydromonitor includes a nozzle which is hydraulically associated with the first pipeline, and extends through the second pipeline, for delivering fluid into the borehole to form a cavity in the coal seam. The hydroelevator entrance is perforated to selectively admit only particles below a certain size. Only the drill pipe extends to the surface. The second pipeline extends only to a casing and releases a slurry into the casing. The first pipeline terminates above the second pipeline where it connects to the drill pipe. The casing and the first pipeline/drill pipe cooperate above the second pipeline to form an area for moving the slurry to the surface. Further a seal is used between the upper end of the second pipeline and the casing to prevent methane gas from moving into the casing from the cavity, except by way of the hydroelevator, and to prevent slurry from moving back down into the cavity from the area between the first pipeline and the casing.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENTS

The preferred embodiments of the present invention will now be described in greater detail with reference to FIGS. 1–6.

These preferred embodiments are described below as being particularly suited for enhancing methane recovery from coal seams. However, the invention is not to be so limited. The device can be used to dislodge any material other than hard, solid rock. That is, if the material can be broken up with fluid pressure, e.g. shale, the present device can be used. Examples of such other uses include: salt cavern formation; increased production in depleted oil fields by creating a low pressure cavity for oil seepage therein and eventual pumping; actual mining of minerals such as silica, uranium, vanadium and coal; foundation or footing cavity formation for buildings or rigs (after the cavity is formed, steel and concrete are introduced into the cavity); and cutting an horizontal channel into a river to divert flow of water.

Also, in the following description, certain dimensions or measurements are given. However, these dimensions are exemplary or preferred, not limitative. For example, the device described below relates to use in a 7-inch well casing. One of ordinary skill would be able to make appropriate dimensional changes so that the device could be accommodated in, e.g., a 9 $\frac{5}{8}$-inch well casing.

Figure 1:
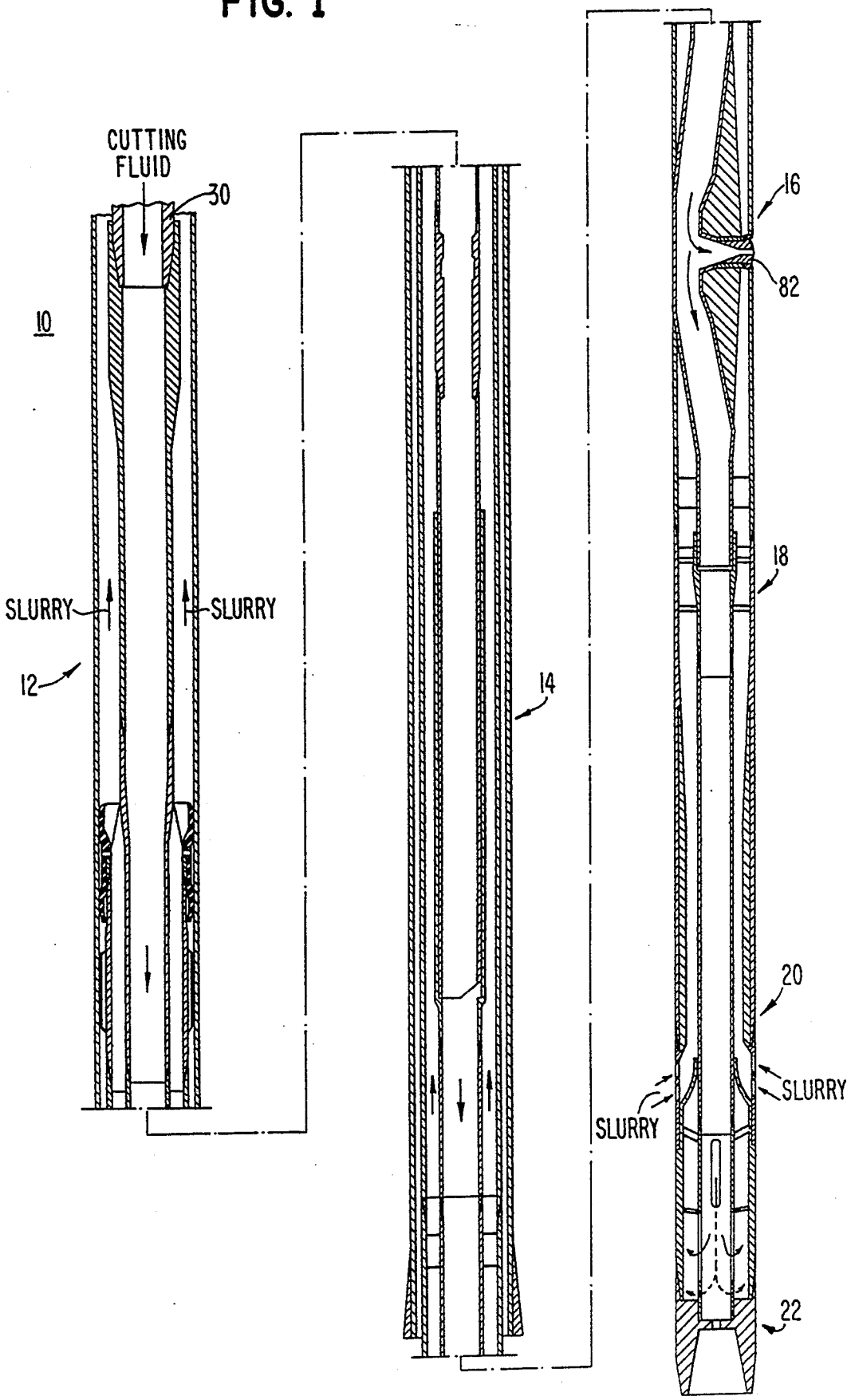
FIG. 1 is a longitudinal sectional view of an hydraulic device for forming a cavity in a borehole, according to the present invention.

The overall device is shown in FIG. 1 and is indicated generally by reference numeral 10. The device 10 may include the following sections described according to the direction of fluid movement: hub section 12; tube section 14; hydromonitor 16; spacer or conversion sub 18; hydroelevator 20; and drill bit box 22. Each of the sections is connected at the joints thereof via threads and/or seals (O-rings) so that the sections do not disconnect during operation and so that methane gas moving up the device does not escape at the joints.

The device 10 is modular, meaning that the components are separately formed and can be connected in varying orientations. For example, the tube section 14 can be used in any number or may not be used at all as desired for the particular circumstance. Also, although in the first embodiment described the hydromonitor 16 (with hydraulic nozzle) is above the hydroelevator 20, with a spacer sub 18 therebetween, the hydroelevator 20 could be connected above the hydromonitor 16 without a spacer sub, as described below for a second embodiment.

The individual sections of the first embodiment are shown in greater detail in FIGS. 2–5, and are discussed more fully below.

Figure 2:
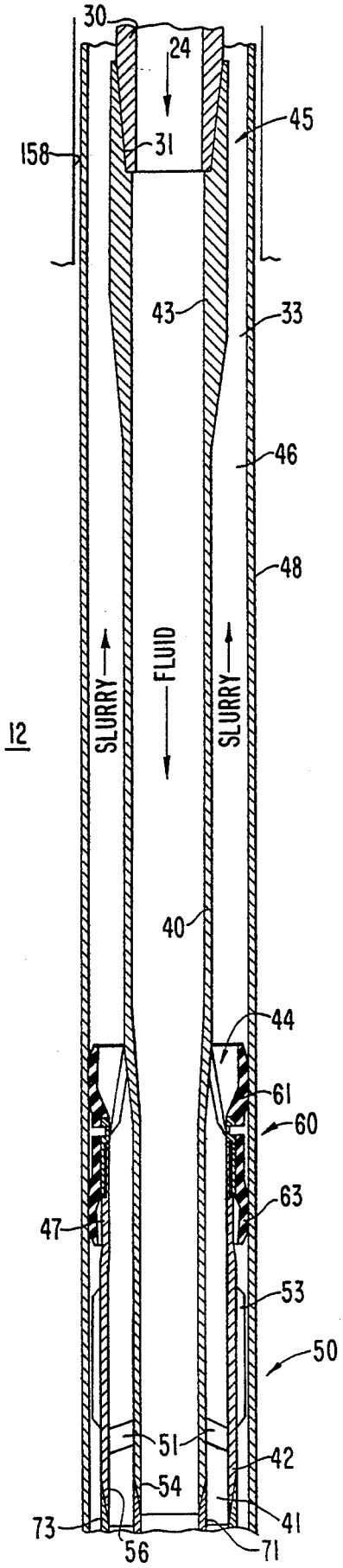
FIG. 2 is a longitudinal sectional view of the hub section of the device.

FIG. 2 illustrates the hub section 12 which is designed to be connected to a conventional drill pipe or string 30. The hub section 12 includes concentric inner 40 and outer 42 tubes. The inner tube 40 has a thickened upper portion 43 with a conventional connector 45, i.e. a threaded box 31, for connection to the drill pipe 30. Standard 3 $\frac{1}{2}$" or 4" drill pipe 30 threads into the box 31.

A volumetric area 33 between the inner and outer tubes is intended to approximate the volumetric area between the drill pipe 30 and casing 48.

The inner tube 40 carries cutting fluid 24 down into a lower portion of the device 10. A space 41 between the inner tube 40 and outer tube 42 carries slurry and methane gas upward from a lower portion of the device 10.

The outer tube 42 is left open at an upper end 47 thereof so that the slurry can move from an annulus 44 of the outer tube 42 into an annulus 46 of the casing 48 surrounding the inner tube 40 and drill pipe 30 as the slurry moves up the device 10 to the surface.

The upper end 47 of the outer tube 42 also receives a seal 60 for sealing the outer tube 42 of the hub section 12 against the casing 48. The seal 60 includes upper and lower annular lips or sealing surfaces, 61 and 63, respectively. The seal 60 is preferably made of rubber or urethane so that it can easily conform to pipe diameters, while at the same time being durable.

The seal 60, by abutting the casing 48, helps to prevent coal from dropping out of the upward moving slurry and falling down into a gap which would otherwise exist between the outside of the device 10 and the casing 48. The seal 60 also is intended to prevent the flow of methane and solid particles upward between the device 10 and the casing 48. The space between the device 10 and the casing 48 cannot be immovably sealed off because the device 10 must be raised or lowered in order to adjust the location of the cutting nozzle discussed below with respect to the coal seam.

Because of this seal 60, a gas bubble can accumulate at the top of the cavity being formed, as discussed below. As the gas bubble forms, the liquid stream of the hydraulic nozzle of the device begins operating in gas instead of liquid, which significantly facilitates cutting of the coal seam.

The hub section 12 also includes a strengthened portion 50 having supports 51 welded to the inner and outer tubes 40, 42. These supports 51 are designed to transfer the torque from the drill pipe 30, through the inner tube 40, and finally to the outer tube 42.

The device 10 from the drill bit box 22 to the top of the hydromonitor 16 has the inner and out tubes connected in various spots by welded supports 51. The concentric pipes of the tube section 14, which extend from the top of the hydromonitor 16 to the bottom of the hub section 12, are not connected together.

Fins 53 on the sides of the outer tube 42 of the hub section 12 are for helping to keep the device 10 centered in the casing 48, thereby not allowing the seal 60 to excessively deflect, which would allow for disadvantageous blow by of gas into the casing 48.

Finally, the lowermost portions of the inner and outer tubes 40, 42 of the hub section 12, i.e. ends 54, 56 respectively, are tapered to facilitate assembly of the hub section 12 with a tube section 14, or with the hydromonitor 16, as desired. By tapered is meant angled and threaded, unless otherwise noted.

Figure 3:
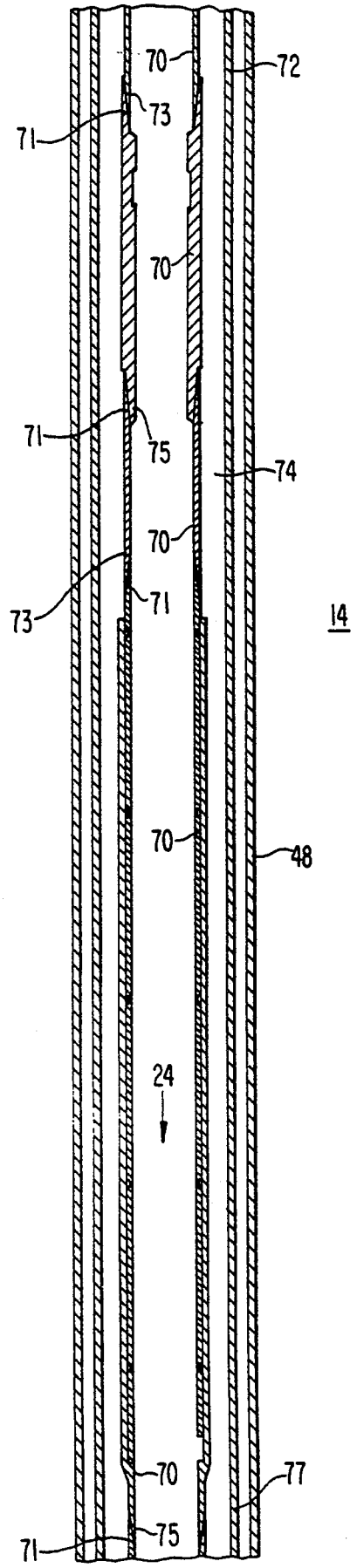
FIG. 3 is a longitudinal sectional view of the tube section of the device.

As shown in FIG. 3, the tube section 14 includes a plurality of inner tubes 70 providing a conduit for the fluid 24 to move downward in the device 10. An outer tube 72 provides an annulus 74 for the upward movement of the slurry. There are no supports between the inner 70 and outer 72 tubes; they are totally independent.

The upper ends 71, 73 of the uppermost inner tube 70 and outer tube 72, respectively, are tapered to facilitate assembly with the ends 54, 56 of the hub section 12. The lower end 75 of each intermediate inner tube 70 is tapered to receive a tapered upper end 71 of another inner tube 70. The lower ends 75, 77 of the lower most inner tube 70 and outer tube 72, respectively, are tapered to facilitate assembly with the hydromonitor 16 described below.

As many inner tubes 70 of the tube section 14 are added as necessary, and the outer tube 72 is lengthened or repeated, to make the device 10 the desired length. This might be as long as 200 feet. The primary purpose of the tube sections 14 is to allow the device 10 to be lowered to whatever depth is necessary without having the hub section 12 exit a base 49 (FIG. 4) of the casing 48. This prevents the device 10 from getting stuck because it would have a tendency not to reenter the casing 48 if it was lowered too far.

Figure 4:
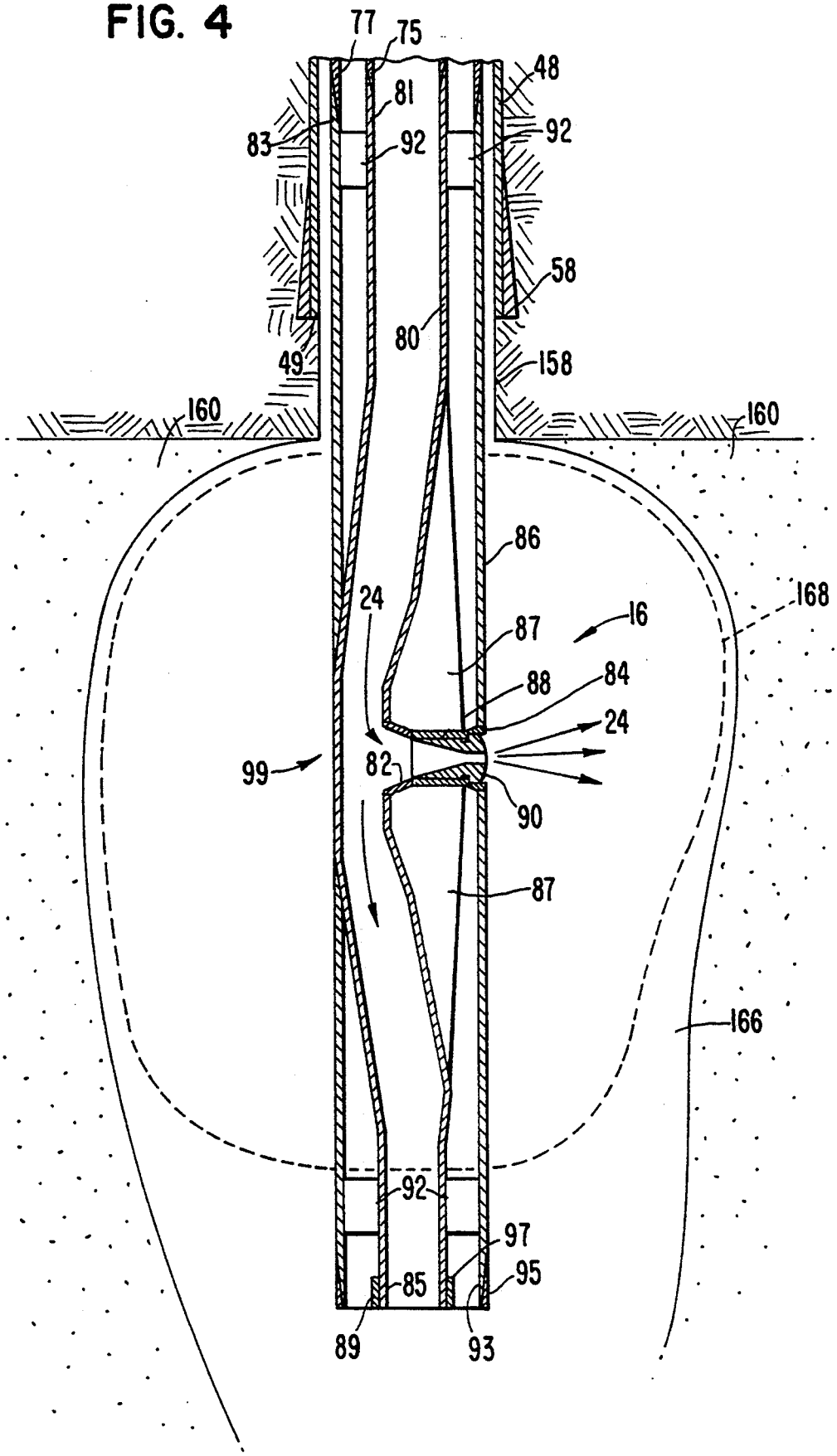
FIG. 4 is a longitudinal sectional view of the hydromonitor section of the device.

As shown in FIG. 4 the hydromonitor 16, which is the cutting nozzle section of the device 10, also consists of dual tubing, with an inner tube 80 configured with a nozzle 82 having an exit 84, and an outer tube 86. Again, supports 92 are interposed between the inner 80 and outer 86 tubes.

A central portion 99 of the inner tube 80 bends to one side, i.e., toward the outer tube 86. This bent central portion 99 of the hydromonitor 16 allows the fluid to bend and exit the horizontal nozzle 82 with a minimum of bending of the fast moving fluid 24. The bend in the inner tube 80 provides for maximum length of the nozzle 82 thereby giving it more effectiveness due to a larger time provided for the fluid 24 to settle with the change in direction.

The members extending from the inner tube 80 to the nozzle 82 and back to the inner tube 80 are webbing plates 87 used to help stabilize the nozzle 82.

A portion 88 of the cutting nozzle 82 is threaded allowing for the use of different sized openings 90, such as 17, 13, and 9 mms in throat diameter. Other sizes could be used as necessary to change the size of the nozzle 82 throat.

The upper ends 81, 83 of the inner 80 and outer 86 tubes, respectively, are tapered to connect with the ends 75, 77, respectively, of the tube section 14, or the ends 54, 56 of the hub section 12, as desired. The lower end 85 of the inner tube 80 is not tapered, as it is received directly within an inner tube 89 of the spacer sub 18, or hydroelevator 20. The lower end 93 of the outer tube 86 is tapered so that it can connect with an upper end 95 on the spacer sub 18, or with the hydroelevator 20.

Figure 5:
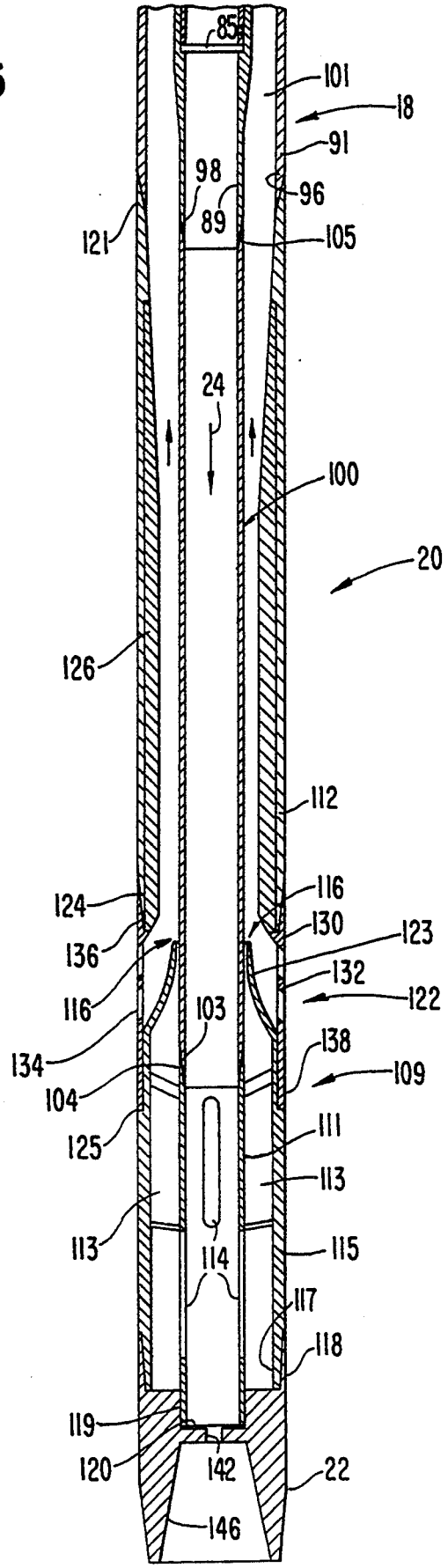
FIG. 5 is a longitudinal sectional view of the spacer sub, hydroelevator and drill bit box sections of the device.

As shown in FIG. 5, the spacer sub 18 is designed to provide spacing between the hydromonitor 16 and the hydroelevator 20, when the hydromonitor 16 is located above the hydroelevator 20, as in this first embodiment. Compare the second embodiment. The spacer sub 18 is also basically a dual tube section 18 with an inner tube 89 and an outer tube 91. Again, the inner tube 89 provides a conduit for fluid to move toward the hydroelevator 20, while the outer tube 91 provides an annulus 101 for the upward movement of slurry.

The upper end 95 of the outer tube 91 is tapered to facilitate assembly with the tapered end 93 of the hydromonitor 16. Similarly, the lower end 96 of the outer tube 91 is tapered to facilitate assembly with the hydroelevator 20 described below.

The upper end 97 of the inner tube 89 is not tapered but is configured cylindrically to receive the cylindrical end 85 of the hydromonitor 16 (FIG. 4). The lower end 98 of the inner tube 89 is tapered and is received by a tapered end of the inner tube of the hydroelevator 20.

As also shown in FIG. 5, the hydroelevator 20 includes generally a blast or inner tube 100, an eductor 122 with a perforated inlet portion 130, and an outer tube 112.

A lower end 103 of the blast tube 100 is tapered to fit an upper end 104 of the eductor 122. An upper end 105 of the blast tube 100 is tapered to receive the tapered end 98 of the spacer sub 18.

The blast tube 100 is similar to the inner tubes discussed above but also functions as the inner surface of the eductor 122. The blast tube 100 must be stronger than the other inner tubes to withstand the impact of the coal and fluid moving horizontally from the coal seam 160.

The eductor 122 includes an inner tube 111 and an outer tube 115, with supports 113 therebetween. Also, the eductor 122 includes an eductor cone portion 123 extending from an upper portion of the outer tube 115. The eductor cone 123 forms an annular space or ring 116 with the inner blast tube 100.

At about a mid-area 109 of the eductor 122 outer tube 115 there is formed a step 125 and the outer tube 115 thins upwardly therefrom. This area 109 receives the perforated inlet portion 130 lower end 138. The lower end 117 of the outer wall 115 is tapered to fit with the tapered upper end 118 of the drill bit stand 22. The lower end 119 of the inner tube 111 is cylindrical to fit in a recess 120 of the drill bit stand 22.

The fluid 24 being directed to the eductor 122 from the hydromonitor 16 and spacer sub 18 passes through the center of the blast tube 100 and exits the eductor 122 through a plurality of radial outlets 114. The fluid then turns up the outside of the blast tube 100 and passes through the annular ring 116 formed between the eductor cone portion 123 and the outside of the blast tube 100.

The reduction in area from the cone portion 123 to the ring 116 causes the fluid to speed up dramatically. By Bernoulli's laws the speed of the fluid causes the pressure to drop. The drop in pressure provides the suction to draw fluids into the device 10 from the coal seam in order to move the slurry to the surface. The coal seam will also be pressured and this also helps to drive the slurry into the device 10.

The blast tube 100 of the hydroelevator 20 is interchangeable which allows for changing of the characteristics of the eductor 122 by changing the outside diameter of the blast tube 100. This changes the effective diameter of the eductor 122 and changes the size of the ring 116.

The outer tube 112 of the hydroelevator 20 includes tapered upper 121 and lower 124 ends for cooperating with the tapered end 96 of the spacer sub 18, and a tapered upper end 136 on the perforated inlet portion 130 of the eductor 122, respectively.

The outer tube 112 also includes an internal sleeve 126 spaced above the eductor 122. The sleeve 126 is a separate member which allows for the easy replacement of this component when it becomes worn.

The perforated inlet portion 130 of the eductor 122 has an alternating slot or perforated area 132 through which the gas-coal passes when entering the device 10. Preferably, the area 132 includes a plurality of $\frac{5}{8}$" slurry return holes 134, in this case thirty-six. This restricts the size of the particles entering the device 10.

Due to the perforated inlet portion 130 of the eductor 122 the size of the coal particles will be significantly smaller than for a conventional eductor. The maximum particle which can pass through the eductor 122 may be only $\frac{5}{8}$ths inch. Also, by merely forming a plurality of openings in an otherwise continuous outer pipe, the device is much more able to withstand the great torques during operation than the device of the '466 patent which has an interrupted outer pipe.

The eductor 122 is capable of removing about three times as much fluid from the cavity being formed as the amount of fluid exiting the nozzle 82. This is intentional since it is preferable to pump the cavity as dry as possible. That is, the eductor 122 creates a partial vacuum so that the cutting nozzle 82 is working in gas and not liquid, which greatly increases cutting efficiency as described below.

FIG. 5 also illustrates that the base of the device 10 includes the drill bit box 22 that is threaded at area 146 so that a conventional drill bit (not shown) can be attached in order to redrill the borehole 158 (FIG. 4) if it becomes clogged. A small hole 142 is formed in the box 22 below the outlets 114 which allows a portion of the fluid to pass into the bottom of the device 10 to clean and cool the drill bit when operated.

Figure 6:
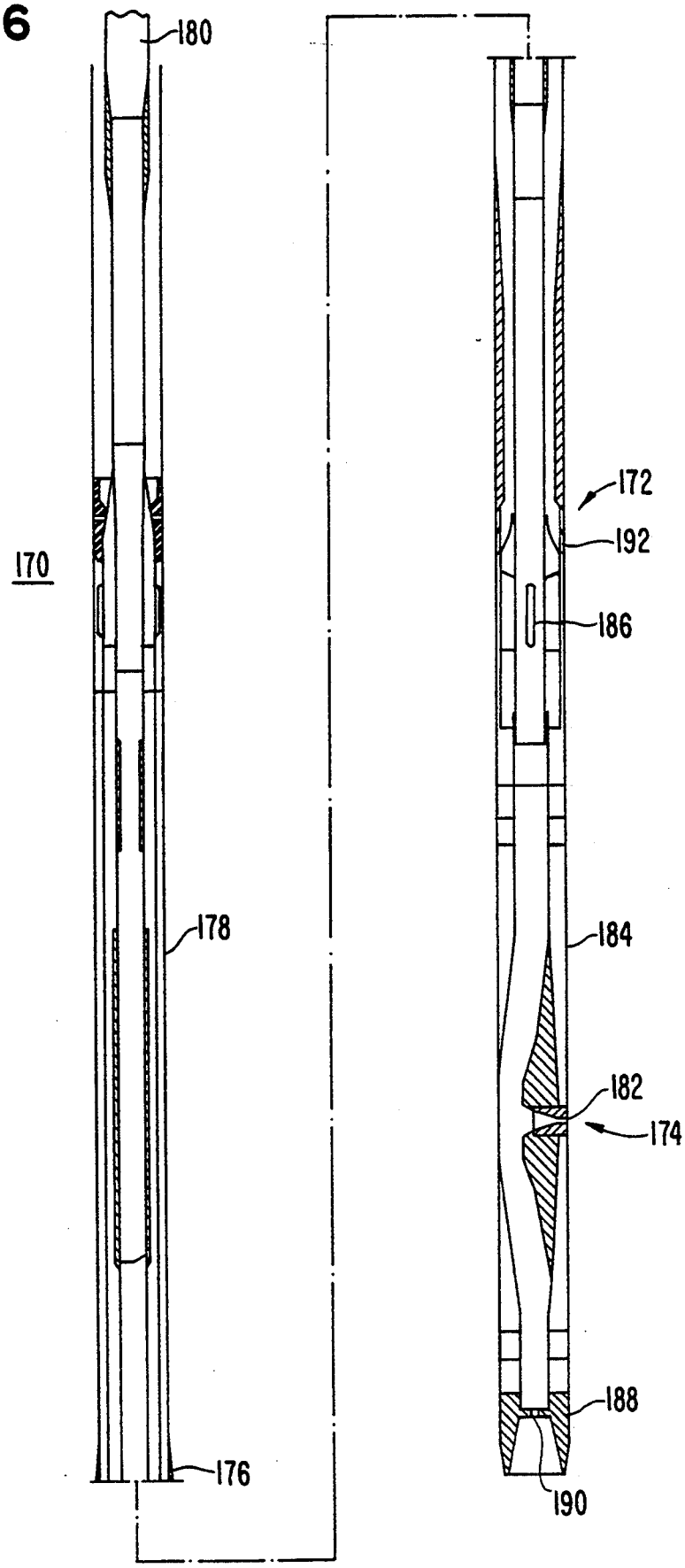
FIG. 6 is a longitudinal sectional view of an alternate embodiment of the device according to the present invention.

FIG. 6 shows an alternate embodiment of the device 170 according to the present invention. In this embodiment, the positions of the hydroelevator 172 and the hydromonitor 174 are reversed. Also, the fluid outlets 186 are above the hydromonitor 174 in this embodiment, not below.

More particularly, this embodiment includes a casing shoe 176, a casing 178 and a drill pipe 180. Further, the hydromonitor 174 includes a cutting nozzle 182. The fluid outlets 186 cause some of the fluid to enter an outer tube 184 and to move to the hydroelevator 172. Further, the device 170 includes a drill bit box 188 intended to receive a conventional drill bit. In this regard, a port 190 is again formed in the hydromonitor 174 for passing fluid to the drill bit. The hydroelevator 172 also includes a perforated eductor portion 192.

As is believed clear from the above, since neither embodiment of the device extends all the way to the surface, the device can use standard oil field well head equipment. As a result, these devices can be used in a methane recovery method, as discussed below. Further, either device is lighter than conventional devices which facilitates insertion, operation and removal. Moreover, the entrance to the hydroelevator is perforated in each embodiment, which prevents blockage.

The above-described devices can be used in the method described in pending U.S. patent application Ser. No. 07/969,967, filed Nov. 2, 1992, and entitled "Method for Hydraulically Forming a Cavity in a Borehole," by the same inventors herein, the disclosure of which is expressly incorporated herein.

In general with reference to FIG. 4, the first step of the method is to drill from the surface a borehole 158 to a short distance above a coal seam 160 using a conventional drill (not shown). The depth of the borehole 158 may be several thousand feet. A distance of 10 to 40 feet is needed above the coal seam 160 in order to set a casing shoe 58 that is sturdy. At this point a 7 inch casing 48 is set and cemented as is conventional.

After setting the casing 48, the borehole 158 is extended by drilling forward with a 6 $\frac{1}{4}$ inch bit. The borehole 158 is drilled to a depth necessary to provide a space so that the device 10 can mine the entire thickness of the coal seam.

The conventional drill is removed, the device 10 is installed on the drill pipe 30, the device 10 is lowered to the bottom of the borehole 158, is activated and is moved vertically. The drill pipe 30 supports the device 10 and allows it to be turned, raised and lowered in order to direct the nozzle 82 as desired, at the coal seam 160. The device 10 has an outside diameter of 5 $\frac{1}{2}$ inches leaving about a three-eighths of an inch clearance on each side of the device 10 when centered in the extended borehole 158.

Water, with or without chemical or mechanical admixtures, is delivered under pressure from a pumping station on the surface through the inner tubes 40, 70, 80, 89, 100 and 111. Some of the water enters the nozzle 82 and then flows as a high-pressure jet into the coal seam 160 for hydraulic washout of coal, thereby forming a cavity 166. The remaining portion of water enters the return fluid outlets 114 and then enters as a high-pressure jet into the hydraulic elevator 20 via the venturi effect of the ring 116 and blast tube 100. As this occurs, a rarefaction zone is formed, whereby the slurry resulting from coal washout is drawn into the hydroelevator 20. Thereupon the slurry is brought to the surface via the outer pipes 112, 91, 86, 72, 42, annulus 44, and annulus 46.

The cavity 166 is sealed from the borehole 158 via the seal 60. Once sealed, any methane gas escaping through fractures in the coal seam 160 is trapped below the seal 60 and forms a gas bubble 168. As hydraulic cutting of the cavity 166 continues, more fractures are exposed and methane is released from the coal seam to the relatively lower pressure cavity. This methane gas is also trapped by the seal 60 and increases the size of the gas bubble 168. Gas such as air or nitrogen can be added to the cutting fluid 24 introduced into the device 10 to increase the size of the gas bubble. As the cutting continues, the device's nozzle 82 ejects a jet stream into the gas bubble 168, not into a liquid. The cutting nozzle 82 is rendered much more efficient and has a significantly larger cutting range when it is operating in gas versus a liquid, because it is easier for liquid to move through gas than through liquid.

As the slurry is brought to the surface, the solids and gases are separated: the slurry goes into a pit and the methane dissipates. The solids of the slurry settle out and the liquid portion is filtered into large tanks and reused in the device 10. A pump is used to pump the water from the pit to the filter system. Another pump is used to pump the water down the device 10.

At the conclusion of cavity formation, which takes approximately 6–10 hours, there will be no more slurry. The device 10 is then removed from the top of the well. The well is then hooked up to standard oil field water separation equipment. The gas flows into a pipeline.

That is, methane recovery equipment is provided at the surface end of the borehole 158. The methane is recovered into a gathering system and transported to a pipeline. It may be liquified or compressed and stored. It may be cleaned, e.g., to remove air and water and extract carbon dioxide therefrom. Any remaining water will either be put into tanks, trucked away or will go into a water disposal pipeline to a disposal well.

It is desired that the device cut a balloon-like cavity 166 approximately 8–15 feet in diameter. This increases the borehole 158 diameter significantly. The increased diameter lowers pressure, stimulates the borehole 158, and increases the probability that some additional fractures will be intersected naturally and allow large volumes of methane gas to enter the cavity 166. In addition it allows for the intersection with more fractures in the vicinity of the borehole 158. Fractures within the coal seam 160 are closely spaced and many of them are encountered when the borehole 158 is widened.

Most importantly, the increase in the radius results in moving the pressure curve out away from the borehole 158 by at least an amount equal to the radius of the cavity 166. Since the amount of gas released from the coal is a function of the pressure, the total gas recovered and the rate at which it is recovered will increase.

With particular regard to the second embodiment of the device described above, the device 170 is lowered into the borehole 158 to the top of the coal seam 160. Since the nozzle 182 is below the hydroelevator 172, this allows downward movement cavity formation which further prevents clogging and binding. The device is moved downward to form the cavity, as high pressure water is pumped through the cutting nozzle 182 and into the borehole. The slurry mixture, with the aid of the methane gas present, enters the perforated eductor portion 192 of the hydroelevator 172 and is brought to the surface via the hydroelevator 172.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

We claim:

1. An hydraulic device for forming a cavity in a borehole drilled from a surface, comprising:

(a) a hub section being connectable to a drill pipe, and being sealable against a casing, wherein only the drill pipe extends to the surface, and wherein the hub section includes an inner tube, a drill pipe connector on an upper portion of the inner tube, an outer tube concentric with the inner tube, and a seal attached to an upper end of the outer rude;

(b) a hydromonitor section, including an inner tube, and an outer tube generally concentric with the inner tube, wherein the hydromonitor includes an hydraulic nozzle having a first end in fluid connection with the inner tube of the hydromonitor and a second end connected to the outer tube of the hydromonitor and being open to an exterior of the device, said hydraulic nozzle for forming a cavity in the borehole; and (c) a hydroelevator, located below the hydromonitor, which is below the hub section, for removing a slurry from the borehole as the cavity is formed, wherein the hydroelevator includes an inner blast tube, an eductor connected to the blast tube and including a perforated inlet portion, and an outer tube concentric with the inner blast tube and connected to the perforated inlet portion of the educator, wherein the eductor comprises:

an inner tube;

an outer tube concentric with the inner tube;

a hole formed in the inner tube of the eductor to render the inner and outer tubes of the eductor in fluid communication with each other, and a cone portion extending from the outer tube of the eductor which extends toward but is spaced from the inner blast tube by an annular space, wherein the outer tube of the hydroelevator includes a removable sleeve located on an inner surface thereof, wherein the casing has a first end and a second end, the first end being near the surface and the second end being near a coal seam, wherein the device is received by the casing witch the seal abutting adjacent the second end of the casing.

2. The device as recited in claim 1, wherein the hub section is connected to the hydromonitor, and hydromonitor is connected to the hydroelevator.

3. The device as recited in claim 1, wherein a first double concentric pipe section is interposed between the hub section and the hydromonitor and a second double concentric pipe section is interposed between the hydromonitor and the hydroelevator.

4. The device as recited in claim 1, further comprising:

a drill bit box for receiving a drill bit.

5. The device as recited in claim 1, further comprising a cutting fluid pumping station on the surface which is in fluid communication with the drill pipe, the inner tubes of the hub section, hydromonitor, and hydroelevator.

6. The device as recited in claim 1, wherein a slurry return passage comprises:

the outer tubes of the hydroelevator, hydromonitor and hub section, and a space between the casing and the drill pipe.

7. An hydraulic device for forming a cavity in a borehole drilled from a surface, comprising:

(a) a hub section being connectable to a drill pipe, and being sealable against a casing, wherein only the drill pipe extends to the surface, and wherein the hub section includes an inner tube, a drill pipe connector on an upper portion of the inner tube, an outer tube concentric with the inner tube, and a seal attached to an upper end of the outer tube;

(b) a hydromonitor section, including an inner tube and an outer tube generally concentric with the inner tube, wherein the hydromonitor includes an hydraulic nozzle having a first end in fluid connection with the inner tube of the hydromonitor and a second end connected to the outer tube of the hydromonitor and being open to an exterior of the device, said hydraulic nozzle for forming a cavity in the borehole; and (c) a hydroelevator, located between the hub section and the hydromonitor, for removing a slurry from the borehole as the cavity is formed, wherein the hydroelevator includes an inner blast tube, an eductor connected to the blast tube and including a perforated inlet portion, and an outer tube concentric with the inner blast tube and connected to the perforated inlet portion of the eductor.

8. The device as recited in claim 7, wherein a first double concentric pipe section is interposed between the hub section and the hydroelevator and a second double concentric pipe section is interposed between the hydroelevator and the hydromonitor.

9. The device as recited in claim 7, further comprising:

a drill bit box for receiving a drill bit.

10. The device as recited in claim 7, wherein the eductor comprises:

an inner tube;

an outer tube concentric with the inner tube; and a hole formed in the inner tube of the eductor to render the inner and outer tubes of the eductor in fluid communication with each other.

11. The device as recited in claim 7, wherein the outer tube of the hydroelevator comprises a removable sleeve located on an inner surface thereof.

12. The device as recited in claim 7, wherein the casing has a first end and a second end, the first end being near the surface and the second end being near a coal seam, wherein the device is received by the casing witch the seal abutting adjacent the second end of the casing.

13. The device as recited in claim 12, further comprising a cutting fluid pumping station on the surface which is in fluid communication with the drill pipe, and the inner tubes of the hub section, hydromonitor, and hydroelevator.

14. The device as recited in claim 13, further comprising a slurry return passage comprising:

the outer tubes of the hydroelevator, hydromonitor and hub section, and a space between the casing and the drill pipe.

15. The device is recited in claim 10, wherein the eductor further comprises:

a cone portion extending from the outer tube of the eductor which extends toward but is spaced from the inner blast tube by an annular space.

16. An hydraulic device for forming a cavity in a borehole drilled from a surface, comprising:

(a) a hub section being connectable to a drill pipe, and being sealable against a casing, wherein only the drill pipe extends to the surface, and wherein the hub section includes an inner tube, a drill pipe connector on an upper portion of the inner tube, an outer tube concentric with the inner tube, and a seal attached to an upper end of the outer tube;

(b) a hydromonitor section, including an inner tube, and an outer tube generally concentric with the inner tube, wherein the hydromonitor includes an hydraulic nozzle having a first end in fluid connection with the inner tube of the hydromonitor and a second end connected to the outer tube of the hydromonitor and being open to an exterior of the device, said hydraulic nozzle for forming a cavity in the borehole; and (c) a hydroelevator, located between the hub section and the hydromonitor, for removing a slurry from the borehole as the cavity is formed, wherein the hydroelevator includes an inner blast tube, an eductor connected to the blast tube and including a perforated inlet portion, and an outer tube concentric with the inner blast tube and connected to the perforated inlet portion of the eductor, wherein the eductor comprises:

an inner tube;

an outer tube concentric with the inner tube;

a hole formed in the inner tube of the eductor to render the inner and outer tubes of the eductor in fluid communication with each other, and a cone portion extending from the outer tube of the eductor which extends toward but is spaced from the inner blast tube by an annular space, wherein the outer tube of the hydroelevator includes a removable sleeve located on an inner surface thereof, wherein the casing has a first end and a second end, the first end being near the surface and the second end being near a coal seam, wherein the device is received by the casing with the seal abutting adjacent the second end of the casing.

17. The device as recited in claim 16, further comprising a slurry return passage comprising:

the outer tubes of the hydroelevator, hydromonitor and hub section, and a space between the casing and the drill pipe.

* * * * *